United States Patent [19]

Hintsa

[11] Patent Number: 4,928,467

[45] Date of Patent: May 29, 1990

[54] PANEL FASTENER

[76] Inventor: Roy A. Hintsa, 198 National Drive, Woodbridge, Ontario, Canada, L4L 3E4

[21] Appl. No.: 193,584

[22] Filed: May 13, 1988

[51] Int. Cl.[5] ..... E04B 1/38

[52] U.S. Cl. ..... 52/511; 52/510

[58] Field of Search ..... 52/506, 508, 511, 510, 52/235; 248/222.2

[56] References Cited

U.S. PATENT DOCUMENTS

| | | | |
|---|---|---|---|
| 459,844 | 9/1891 | Thomas | 248/222.2 |
| 2,250,582 | 7/1941 | Jentzer | 52/508 |
| 3,681,881 | 8/1972 | Baran | 52/508 |
| 4,062,161 | 12/1977 | Schuback | 52/506 |
| 4,311,295 | 1/1982 | Jamar, Jr. | 248/222.2 |
| 4,553,366 | 11/1985 | Guerin | 52/508 |

*Primary Examiner*—David A. Scherbel
*Assistant Examiner*—Michele A. Van Paten

[57] ABSTRACT

A wall panel hanging system according to the present invention comprises a top hanging track horizontally secured to a wall adjacent the junction of the wall and ceiling which cooperates with clips attached to a panel and by means of which the panel is hung from the top hanging track. The top hanging track has a forwardly facing shank receiving portion at the upper edge thereof and a forwardly extending shoulder therebelow. The track further includes a flange area for receiving fasteners and by means of which the track is secured to a wall. Each clip includes a top shank sized for close reception in said shank receiving portion and a clip shoulder spaced below said top shank and cooperating with said forwardly extending shoulder when the shank is received in said top hanging track. The cooperating shoulders effect positioning of the clip in the track such that the clip shoulder is above and in support engagement with the forwardly facing shoulder of the top hanging track. The clips are first partially inserted in the top hanging track by inserting the shank in the shank receiving portion with the panel at an angle to the wall, whereafter the panel can be moved towards the wall and positioned to effect cooperation between the shoulders of the top hanging track and the clips provided on the panels. The clips are provided at selected points, whereas the track is secured in lengths along the wall. The reception of the clip in the track still allows horizontal sliding of the panel along the wall until further engagement with the wall is provided.

12 Claims, 1 Drawing Sheet

PANEL FASTENER

FIELD OF THE INVENTION

The present invention relates to a wall panel hanging system having a wall engaging portion and a panel engaging portion which, when properly inserted, effect hanging of the panel adjacent the wall. In particular, the invention relates to a wall panel hanging system which is convenient to use and does not require excessive vertical movement of the panels to effect securement of the panel.

BACKGROUND OF THE INVENTION

Many arrangements have been proposed for securing of panels to a support wall, however, in the hanging of acoustical panels which are typically laminated glass fiber panels, the prior art hanging systems have primarily relied on a vertical sliding of the panel downwardly into locking members provided on the wall structure. The extent of the vertical movement would be at least about one-half of an inch and resulted in a substantial gap between the panel and the ceiling. Obviously in the hanging of panels it is important to effect a horizontal alignment of the panels as well as vertical alignment to allow the butt connection of panels when suspended on a wall. Thus, the degree of accuracy required in fastening of various components has led to fairly complex systems requiring the accurate location of various hardware applied to the walls and panels.

SUMMARY OF THE INVENTION

According to the present invention, a simplified method of hanging wall panels is taught which requires securement of a top hanging track horizontally adjacent the junction of the wall and the ceiling. This top hanging track has a forwardly facing top receiving shank portion with a forwardly extending shoulder therebelow with a suitable flange area for effecting securement of the top hanging track to a wall. A clip is used which is secured to the panel in a conventional manner, with this clip having a top shank for close reception in the forwardly facing top receiving shank portion. A shoulder is provided on the clip which cooperates with the shoulder of the top hanging track and these shoulders cooperate to provide support surfaces to suitably hang the panel from the track. Thus, the shank and the top receiving shank portion cooperate to maintain the clip in close proximity to the hanging track and the overlapping shoulders effect a load transfer region by means of which the panel is supported from the track. The clip includes suitable flanges to effect securement of the clip to the panel.

Several clips will be positioned along the top edge of the panel to provide localized support areas. The clips are horizontally slidable within the track to allow positioning of the panels. For example, if a panel is already hung, an adjacent panel about to be hung may be positioned near the first panel, but spaced therefrom to allow the installer sufficient room to easily insert the clips of the panel in the top hanging track and, once so inserted, he can then slide the panel into abutment with the panel already suspended.

BRIEF DESCRIPTION OF THE DRAWINGS

Preferred embodiments of the invention are shown in the drawings, wherein.

DETAILED DESCRIPTION OF THE PREFERRED EMBODIMENTS

Figure 3:
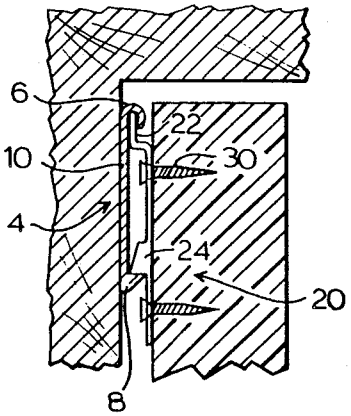
FIG. 3 shows a view of the track and clip in operative position supporting a panel adjacent a wall.

The wall panel hanging system 2 has a top hanging track 4 which is secured to a wall adjacent the junction of the wall and the ceiling. The top hanging track is horizontally mounted and care is exercised in positioning this below the ceiling. The top hanging track will determine the final position of the panel. This top hanging track 4 has a forwardly facing top receiving shank portion 6 and a forwardly extending shoulder 8 located below the top receiving shank portion. A flange area 10 is provided for receiving fasteners to effect securement of the top hanging track to a wall. Any suitable securement arrangement can be used, such as screws.

The panel clip 20 has a top shank 22 for close reception in the forwardly facing top receiving shank portion 6. Shoulder 24 below the top shank 22 is positioned for cooperation with forwardly extending shoulder 8 of the top hanging track 4, such that a generally horizontal support area is defined when the two shoulders are positioned with the clip in operative reception in the top hanging track 4. This operative position is generally shown in FIG. 3. It should be noted, in the operative position, the clip is slidable along the length of the track whereby horizontal placement of the panel is easily accomplished by sliding of the panel. The panel clip 20 includes panel engaging flanges 26 and 28 by means of which a clip can be secured to the laminated panel. In the example shown, screws 30 pass through the flange areas 26 and 28 and are received in the panel. The panel in this area has a resin applied thereto to stiffen the panel and, in effect, prepare the panel for reception of screws 30.

Figure 2:
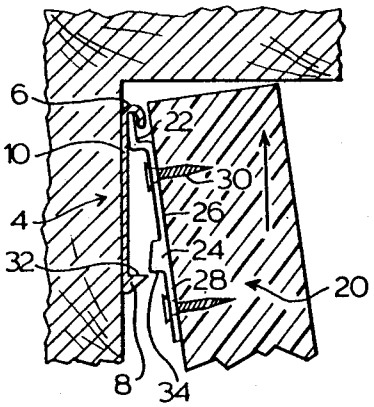
FIG. 2 shows positioning of the clip within the top hanging track.
Figure 1:
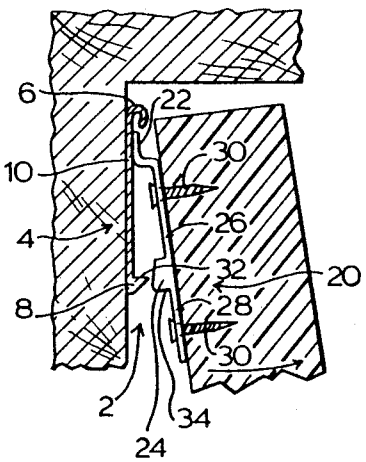
FIG. 1 is a sectional view showing a panel and clip about to be inserted in a top hanging track.

As clearly shown in the drawings, the panel is first angled outwardly from the wall at a position slightly below its final position to allow insertion of top shank 22 in the forwardly facing top receiving shank portion 6 of the top hanging track 4. Once this top shank 22 has been so inserted in the top hanging track 4 by generally a vertical shifting of the panel upwardly as illustrated in FIG. 2, the panel is then rotated towards the wall as indicated in FIG. 3 with the top shank 22 fully received within the forwardly facing top receiving shank portion 6 of the track. This causes shoulders 8 of the track and 24 of the clip to overlap and provide horizontal load transfer surfaces as clearly illustrated in FIG. 3. The weight of the panel serves to bias the shoulders into continuous engagement and, in effect, creates a gravity bias ensuring the clip remains in the operative position within the track. The overlapping shoulders only require a small tolerance, such that a significant vertical shift of the panel downwardly to effect locking is not required, as is the case with many conventional systems which rely on a hook being received in a slot provided adjacent the wall. Overlapping shoulders 8 and 22 define horizontal load transfer surfaces 32 and 34, in the operative position, and thus support the panel. Shank 22 in combination with shank receiving portion 6 limit movement of the panel and this, in combination with the gravity bias caused by the weight of the panels, maintains the shoulders in the operative position of FIG. 3.

The lower portion of the panel would include other arrangements for maintaining the panel adjacent the support wall and a preferred arrangement is disclosed in my Co-pending Application entitled "Fiber Panel Fastener" having the same filing date as the present application. The entire contents of this co-pending application is incorporated herein by reference. The fastener disclosed in my co-pending case has an open center winding which is screwed into the panel to effect engagement of the winding with the panel and this winding can then be used with any other arrangements for maintaining the panel adjacent the wall. The position of the panel adjacent the wall is adjusted by increasing the depth of penetration of the winding or slightly decreasing the depth of penetration of the winding, thus simplifying alignment. The diameter of the winding will vary with the load requirements of the fastener, however, in the case of fiberglass panels of a thickness of greater than one-half of an inch, the winding is preferably of a diameter greater than about one inch and of a pitch of about one quarter of an inch. Such a fastener has proven satisfactory, although the fastener is not limited to these particular characteristics which are provided as examples. These characteristics can vary with the particular panel for which it is to be used and the load requirements expected to the fastener. The winding and the pitch is chosen such that a central core of the panel interior to the winding is defined which can still effect load transfer to a larger area of the panel adjacent this core, but exterior to the winding. This arrangement is in direct contradiction to the screw approach previously taken which clearly required reinforcing of the panel by means of applying resins thereto.

It can be appreciated that the above wall panel hanging system allows close positioning of the panels adjacent the ceiling structure while still simplifying installation of the panels by the installer. The vertical shifting of the clips within the track allows the panels to be initially positioned within the track and accurately located, one beside the other, once suspended from the track. Both the clip and the track can be of extruded aluminum or aluminum alloy or other suitable material and cut to appropriate lengths. Clips will be applied at various positions adjacent the top of the panels and can be secured in any satisfactory manner. These clips are normally installed by the installer in the field, however, the panels can be prepared during manufacture thereof by providing a reinforcing in selected locations across the top of the panel.

Although various preferred embodiments of the present invention have been described herein in detail, it will be appreciated by those skilled in the art, that variations may be made thereto without departing from the spirit of the invention or the scope of the appended claims.

The embodiments of the invention in which an exclusive property or privilege is claimed are defined as follows:

1. A wall panel hanging system comprising a top hanging track to be horizontally secured to a wall and clips for securement to a panel, said top hanging track having a forwardly facing shank receiving portion at the upper edge thereof and a forwardly extending shoulder therebelow, said track further including a flange area for receiving fasteners; each clip including a top shank sized for close, free sliding reception in said shank receiving portion and an integral clip shoulder spaced below said top shank and cooperating with said forwardly extending shoulder when said top shank is generally fully received in said top hanging track whereafter said clip shoulder may be brought into support engagement with said forwardly facing shoulder with said top shank generally fully received in said top hanging track, said clip shoulder acting as the only surface of said clip opposing movement of said clip shoulder past said forwardly facing shoulder when said clip shoulder is in support engagement with said forwardly facing shoulder.

2. A wall panel hanging system as claimed in claim 1 wherein said shank receiving portion and said shank are shaped to provide a limited rotational connection therebetween allowing initial insertion of said clip at an angle to said hanging track and subsequent pivotal movement of said clip to bring the clip into operative position generally aligned with the track and with said clip supported by the shoulder of said track.

3. A wall panel hanging system as claimed in claim 2 wherein said hanging track is of an extruded section and each clip is of an extruded section.

4. A wall panel hanging system as claimed in claim 3 wherein said forwardly extending shoulder is adjacent the lower edge of said track.

5. A wall panel hanging system as claimed in claim 4 wherein said clip shoulder and said forwardly facing shoulder are positioned on said clip and on said track to define opposed abutting horizontal load transfer surfaces when said shank is fully received in said shank receiving portion.

6. A wall panel hanging system as claimed in claim 4 wherein said clip has a flat mounting flange portion below said clip shoulder by means of which said clip is secured to a panel.

7. In combination a wall panel, a top hanging track, and aligned clips secured to said wall panel adjacent an upper edge of said wall panel, said top hanging track being horizontally secured to a wall adjacent an upper edge thereof, said top hanging track having a forwardly facing shank receiving portion at the upper edge thereof and a forwardly extending shoulder therebelow, said track further including a flange area below said forwardly facing shank receiving portion which receives fasteners securing the track to the wall; each clip including a top shank sized for close reception in said shank receiving portion and an integral clip shoulder spaced below said top shank which coopereates with said forwardly extending shoulder of said track when said shank is generaly fully received in said top hanging track whereafter said clip shoulder may be brought into support engagement with and above said forwardly facing shoulder with said shank generally fully received in said top hanging track, said shank moving within said shank receiving portion to allow said clip shoulder to be brought into support engagement with said forwardly facing shoulder such that the weight of the panel is transferred to said track via said clip shoulders.

8. In the combination of claim 7 wherein said shank receiving portion and said shank are shaped to provide a limited rotational connection therebetween allowing initial insertion of said clip at an angle to said hanging track and subsequent pivotal movement of said clip to bring the clip into operative position generally aligned with the track and with said clip supported by the shoulder of said track.

9. In the combination of claim 8 wherein said hanging track is of an extruded section and each clip is of an extruded section.

10. In the combination of claim 9 wherein said forwardly extending shoulder is adjacent the lower edge of said track.

11. In the combination of claim 10 wherein said clip shoulder and said forwardly facing shoulder are positioned on said clip and on said track to define opposed horizontal load transfer surfaces when said shank is fully received in said shank receiving portion.

12. In the combination of claim 10 wherein said clip has a flat mounting flange portion below said clip shoulder by means of which said clip is secured to a panel.

* * * * *